United States Patent [19]

Schepel

[11] Patent Number: 4,479,454

[45] Date of Patent: Oct. 30, 1984

[54] MULTI-POSITION MOORING LINE APPARATUS

[76] Inventor: Donald D. Schepel, 2503 Lakepoint La., Clearwater, Fla. 33520

[21] Appl. No.: 503,820

[22] Filed: Jun. 13, 1983

[51] Int. Cl.[3] ..... B63B 21/54; B63B 21/04

[52] U.S. Cl. ..... 114/230; 211/69; 248/512; 114/218

[58] Field of Search ..... 114/219, 220, 230, 231; 441/3, 4, 5; D30/44; 15/435; 211/69.1, 70, 69; 248/512, 513; 46/91

[56] References Cited

U.S. PATENT DOCUMENTS

| | | | |
|---|---|---|---|
| 1,520,716 | 12/1924 | Judd | 114/218 |
| 2,602,617 | 7/1952 | Muth | 248/513 |
| 2,694,538 | 11/1954 | Consolo | 114/230 |
| 3,187,707 | 6/1965 | Carbone | 114/230 |
| 3,280,784 | 10/1966 | Stainbrook | 114/230 |

*Primary Examiner*—Trygve M. Blix
*Assistant Examiner*—Patrick W. Young
*Attorney, Agent, or Firm*—Ronald E. Smith

[57] ABSTRACT

A mooring device having a plurality of functional positions of adjustment. The device facilitates the docking of a boat by obviating the need to disembark from the boat as the boat approaches a pier or wharf. Specifically, the apparatus includes an elongate, flexible arm member having a line-retaining member formed at the distal free end thereof that presents the mooring lines to the boat operator while such operator remains on the boat. The arm projects from a novel hemispherical in configuration base member having a plurality of circumferentially and angularly spaced bores provided therein and such base member is further rotatable about an axis of symmetry so that the positions that the apparatus may assume are virtually unlimited.

3 Claims, 4 Drawing Figures

FIG_3
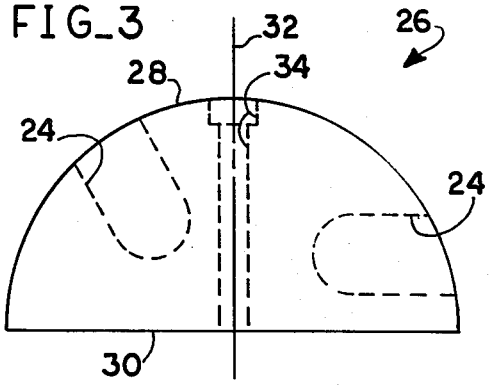
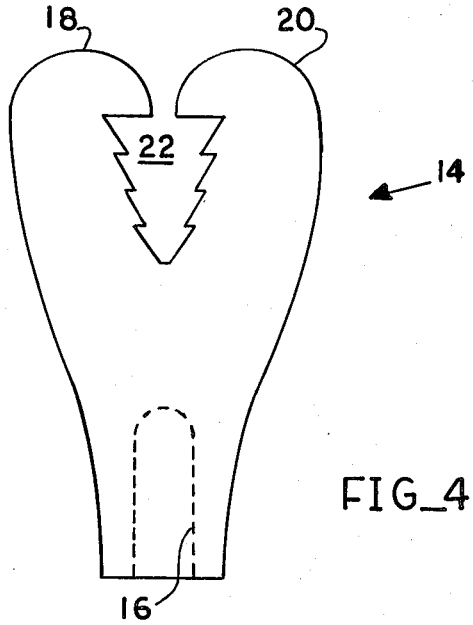
FIG_4
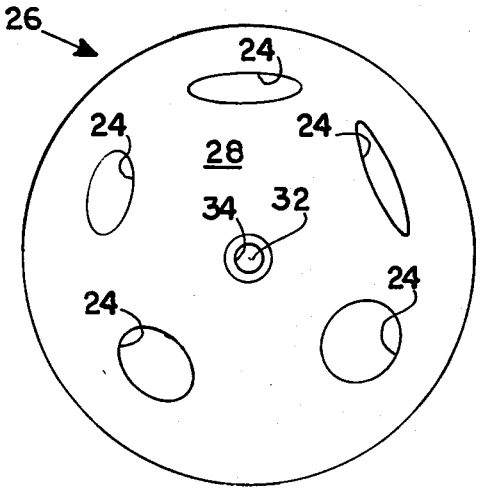
FIG_2

MULTI-POSITION MOORING LINE APPARATUS

BACKGROUND OF THE INVENTION

1. Field of the Invention

This invention relates, generally, to mooring devices, and more specifically relates to such a device having a unique base means that allows deployment of the operative portion of the device in a plurality of functional positions of adjustment.

2. Description of the Prior Art

A search of United States patents that was conducted prior to the filing of this disclosure located the following United States patents:

| Patentee | U.S. Pat. No. | Date of Issue |
|---|---|---|
| Stainbrook | 3,151,595 | 10-06-64 |
| Benzel | 3,183,877 | 05-18-65 |
| Stainbrook | 3,280,784 | 10-25-66 |
| Paul | 4,041,887 | 08-16-77 |
| Barton | 4,280,440 | 07-28-81 |

The field of search included Class/sub-class 114/219, 220, 230, 231.

Some of the earlier devices in the general field of this invention are of metallic construction which is, of course, highly unadvisable in a waterfront environment. Moreover, the devices of the prior art are mechanical constructions having structures that limit or constrain their respective fields of movement. Specifically, most of the earlier devices are permanently mounted to a wharf or pier and are constructed so that the arm that presents the mooring line to the boat owner must always be in the same position. Thus, the boat owner must adapt his docking maneuvers to meet the limitations imposed by the mooring device. There is a need for a mooring device the position of which is easily adjustable by the boat owner. Even more importantly, there is a need for a device that may be positioned in any number of positions, without substantial limitations.

The needed device would provide years of maintenance-free service in a wet environment, would be easy to install, economical to manufacture, and thus affordable to consumers, and would perform its intended function in a reliable manner.

The needed device does not appear in the prior art.

SUMMARY OF THE INVENTION

The longstanding but heretofore unfulfilled need for a mooring device that overcomes the limitations of the prior art is now provided in the form of an elongate flexible rod having a unique line-clamping means at its distal free end and having its proximal end releasably anchored in a highly novel and clearly inventive hemispherical in configuration base member.

The base member is provided with a plurality of bore means formed therein, each of which is adapted to receive the proximal end of the elongate rod that presents the mooring lines to the boat operator. The bores are circumferentially spaced relative to one another about the hemispherical surface of the flat-bottomed base member. Moreover, each bore means is angularly disposed relative to the other bore means. Specifically, the longitudinal axis of symmetry of a first bore means is parallel to the flat undersurface of the base means, a second bore means is inclined at an angle from said first bore means, and the subsequent bore means are similarly angularly disposed relative to each preceding and succeeding bore means. Accordingly, at any one position of the base member, a plurality of positions are available for the arm member, each position representing a different height at which the mooring lines are presented to the boat operator, and each position representing a different alignment of such rod member as well. However, since the base member itself is rotatably mountable, the fixed number of positions of the elongated rod member is extended to a virtually unlimited plurality of positions. Specifically, the hemispherical base member is provided with a bore that is coincident with its vertical axis of symmetry. An elongate screw means is extended through said bore and is securable to a mounting surface (such as a wharf, pier, or piling) for the base member. As such, the loosening of the screw means permits rotation of the base member about its axis of symmetry to any desired position.

It is therefore seen to be the primary object of this invention to provide an apparatus that facilitates the docking of a boat.

A closely related object is to provide an apparatus that will obviate the need for conventional boat-hook devices.

Another object is to provide an apparatus that enhances the safety of the docking procedure, by eliminating the need for the boat operator to jump ashore as part of the docking procedure, and by eliminating the need for the boat owner to precariously lean from the boat being docked.

Still another object is to provide a jam cleat of unique configuration that will releasably secure the distal free end of a conventional mooring line.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 2 is a top plan view of the novel base member.

FIG. 3 is a side elevational view of the novel base member.

FIG. 4 is a side elevational view of the novel jam cleat.

DETAILED DESCRIPTION OF THE PREFERRED EMBODIMENT

Figure 1:
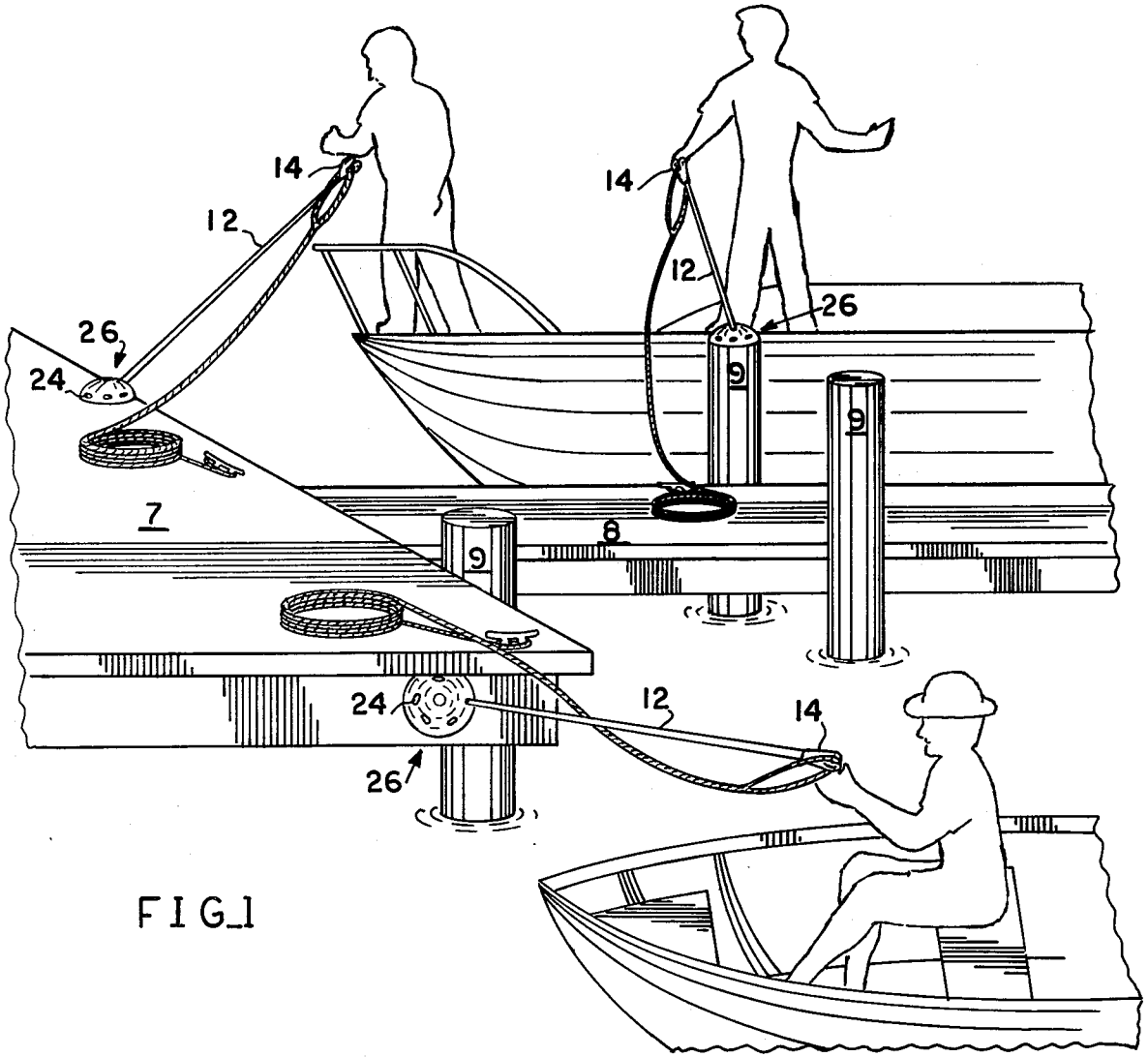
FIG. 1 is a perspective view showing a preferred embodiment of the inventive apparatus deployed in its operative configuration on the decking of a wharf, on the side of a wharf, and on the top of a piling.

Referring now to FIG. 1, it will there be seen that the environment within which the invention is employed is designated by the reference numeral 10 as a whole.

The inventive structure includes an elongate flexible rod 12 that can be formed of any suitable material. One construction that is favored provides a heavy fiber glass tubing with a foam core to make the same buoyant. Thus, if the rod 12 is dropped into the water for any reason, it will float. Of course, the scope of this invention is not limited to an elongate rod that will float, such feature merely being desirable.

A jam cleat 14 is disposed at the distal end of the elongate rod 12, as shown in FIG. 1. FIG. 4 shows the jam cleat 14 in more detail. It will there be seen that the distal end of the elongate rod 12 is received by the complementally formed bore 16 formed in the proximal end of the jam cleat 14. This jam cleat or line hook is preferably made of tough, marine grade Nitrile rubber to support the heaviest of dock lines. Again, the invention is not limited to such specific material in that any sufficiently resilient material will suffice. As is clearly shown in FIG. 4, the distal end of the jam cleat 14 is bifurcated and comprises a pair of complementally formed, transversely opposed arm members 18 and 20 that collectively substantially enclose a saw-toothed cavity 22. The individual teeth of the cavity, as is clear from an inspection of FIG. 4, are reversely oriented vis a vis the opening of such cavity so that lines may easily be inserted into such cavity. The reverse orientation of the teeth, of course, prevents the inadvertent removal of the lines therefrom, but the resiliency of the opposed arm members 18 and 20 allows purposeful retrieval of the same.

The proximal end of the elongate flexible rod 12 is releasably secured by the boat owner into any of the bores 24 formed in the base member 26, as is clear from FIG. 1. Referring now to FIGS. 2 and 3, the novel base means 26 is shown in greater detail. This member 26 is hemispherical in configuration, having an arcuate top surface 28 and a flat bottom surface 30. The axis of symmetry is designated as 32, and, as is clearly shown, a countersunk bore means 34 is formed coincident therewith. When it is desired to mount the novel base means 26 to a wharf 7, pier 8, or piling 9 (FIG. 1), a screw means (not shown) is slidably inserted into such bore means 34 and screwed into the mounting surface. When the screw means has been tightened, the base member 26 will not rotate about its axis of symmetry 32. However, when it is desired to reposition the same, it is a simple matter to release the screw means and to rotate the base member 26 about its axis of symmetry 32 to any position desired. Such base rotation, of course, results in re-positioning of the elongate flexible rod 12.

As the base 26 is rotated, the rod 12 will sweep out a cone, a different cone being swept out depending within which bore 24 the rod 12 is disposed. Such cone will have a vertical or horizontal axis of symmetry, depending upon whether the base 26 is mounted on a horizontal surface or a vertial surface, respectively. FIG. 1 shows two horizontal mountings and one vertical mounting.

The proximal end of the rod 12 is slidably received within a preselected one of the bore members 24 that are circumferentally spaced relative to one another, as is clear from FIG. 2. The angular disposition of the axis of symmetry of each bore means is different from that of each preceding and succeeding bore means. In one embodiment, a first bore means axis of symmetry is inclined at 0 degrees from the horizontal, a second bore means contiguous thereto and circumferentially spaced therefrom has an axis of symmetry inclined 15 degrees from the horizontal, a third circumferentially spaced bore means has an axis of symmetry disposed at a 30 degree angle from the horizontal, a fourth bore means is provided with an inclination of 45 degrees from the horizontal, and a fifth bore means is inclined 60 degrees from the horizontal. In view of the teachings of this dislosure, it will become immediately apparent that any number of bore means 24 can be provided in the novel base member 26, and any angle of inclination can be provided as well.

It will be noted from an inspection of FIG. 2 that the bores 24 having an axis of symmetry disposed at greater angles from the horizontal are disposed radially closer to the axis of symmetry 32 of the base member 26 itself. This particular spacing is not critical, and is merely a matter of convenience in that the 60 degree bore, for example, if positioned as near the periphery of the base member as the 0 degree bore, would simply not be of sufficient depth to adequately and firmly receive the proximal end of the flexible rod 12.

When the inventive apparatus is not in use, the elongate flexible rod 12 and the jam cleat 14 secured thereto are removed from the base member 26 and stored in a suitable clamping device that would conveniently be provided on the pier or wharf itself, preferably out of casual view. Thus, the boatsman, preparing for departure from the dock, simply inserts the proximal end of the flexible rod 12 into an appropriate bore 24, so that such rod would extend over the bow of the boat, generally above the bow mooring cleats of the boat. Just prior to leaving the dock, the boatsman then inserts the looped portion of the bow lines into the jam cleats 14. The boat is then free to leave the dock. Upon returning to the dock, the bow lines will be readily accessible and the problems associated with conventional docking procedures will be obviated. After docking, the rod is simply stored as aforesaid.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A device of the type designed to releasably hold a mooring line so that said line can be readily grasped by a boatsman as a boat approaches its docking location, comprising, an elongate flexible rod member having a proximal end and a distal end, a hemispherical base member having a vertical axis of symmetry, said base member having a convex upper surface, said base member having a flat, circular bottom surface, a plurality of bore means formed in said base member, each of said bore means adpated to slidingly receive the proximal end of said rod member, a first bore means formed in said base member substantially orthogonal to said vertical axis of symmetry and disposed in proximity to said flat bottom surface, a second bore means formed in said base member, said second bore means being angularly disposed to said vertical axis of symmetry at an angle less than ninety degrees and being circumferentially spaced from said first bore means and being spaced more remote from said flat bottom surface relative to said first bore means, a plurality of successive bore means formed in said base member, each successive bore means being angularly disposed relative to said vertical axis of symmetry at an angle less than the preceding bore means and being increasingly remote from said bottom surface of said base member so that a helical pattern of bore means is observed when the base member is seen in plan view, a mooring line having a free, looped end, a cleat member fixedly secured to the distal free end of said rod member, and said cleat member adapted to releasably grasp the free, looped end of said mooring line.

2. The device of claim 1, wherein a mounting bore means is formed in said base member coincident with its vertical axis of symmetry, and wherein said mounting bore means is countersunk to receive a screw means so that said base member can be secured to a mounting surface attendant screw threaded engagement of said screw means and said mounting surface, and whereby said base member can be mounted in any rotational position about said screw means and hence about its vertical axis of symmetry.

3. The device of claim 2, wherein said cleat means comprises a clamping member having a pair of resilient, transversely opposed arm members that are integral with a common bight poriton and which define a cavity there between into which said free, looped end of said mooring line is insertable, said arms having saw tooth-like inner edges that are reversely oriented with respect to the opening of said cavity to readily admit said mooring line while defeating inadvertent removal of said mooring line thereform.

* * * * *